US007857533B2

(12) United States Patent
Takatsuka

(10) Patent No.: US 7,857,533 B2
(45) Date of Patent: Dec. 28, 2010

(54) METHOD OF JUDGEMENT OF INK RIBBON JAMMING

(75) Inventor: Atsunobu Takatsuka, Ibaraki (JP)

(73) Assignee: Nisca Corporation, Minamikoma-Gun, Yamanashi-Ken (JP)

( * ) Notice: Subject to any disclaimer, the term of this patent is extended or adjusted under 35 U.S.C. 154(b) by 0 days.

(21) Appl. No.: 12/356,052

(22) Filed: Jan. 19, 2009

(65) Prior Publication Data

US 2009/0154979 A1 Jun. 18, 2009

Related U.S. Application Data

(62) Division of application No. 11/297,108, filed on Dec. 7, 2005.

(30) Foreign Application Priority Data

Dec. 20, 2004 (JP) ..... 2004-367593

(51) Int. Cl.
*B41J 33/14* (2006.01)
*B41J 17/02* (2006.01)
*B41J 17/36* (2006.01)
*B41J 17/32* (2006.01)

(52) U.S. Cl. ..... 400/223; 400/208; 347/214

(58) Field of Classification Search ..... 400/223, 400/23; 347/217
See application file for complete search history.

(56) References Cited

U.S. PATENT DOCUMENTS 3,748,580 A * 7/1973 Stevens et al. ..... 324/178
4,491,430 A * 1/1985 Kuelzer ..... 400/208
4,629,312 A 12/1986 Pearce et al.
4,747,716 A * 5/1988 van der Eikel ..... 400/249
6,614,461 B2 * 9/2003 Terasaki et al. ..... 347/217
2004/0160220 A1 8/2004 Wendt
2005/0024045 A1 2/2005 Hagino et al.

FOREIGN PATENT DOCUMENTS

JP 61164879 A * 7/1986
JP 03093587 A * 4/1991
JP 2003-231337 A 8/2003
JP 2003237199 A 8/2003
JP 2003237200 A 8/2003

OTHER PUBLICATIONS

IBM Technical Disclosure Bulletin NN82035015, "Microcontrolled Ribbon Motion and Splice Detection System," Mar. 1982, vol. 24, Issue 10, pp. 5015-5016.*

* cited by examiner

*Primary Examiner*—Daniel J Colilla
(74) *Attorney, Agent, or Firm*—Manabu Kanesaka

(57) ABSTRACT

Magnetic force lines 51 are generated in the direction from a first limited portion 52 of an inside peripheral face 50*a* of a ribbon-delivering cylindrical core 50 toward an opposing second limited portion 54. A first magnet is fixed at the first limited portion: a second magnet is fixed at the opposing second limited portion. With the ink ribbon cassette 40 set in a main body of a printer 10, a magnetic sensor 24 takes the position in the middle of the inside of the ribbon-delivery core 50, and detects the magnetic force line 51.

6 Claims, 10 Drawing Sheets

(a)

N poles (b)

S poles

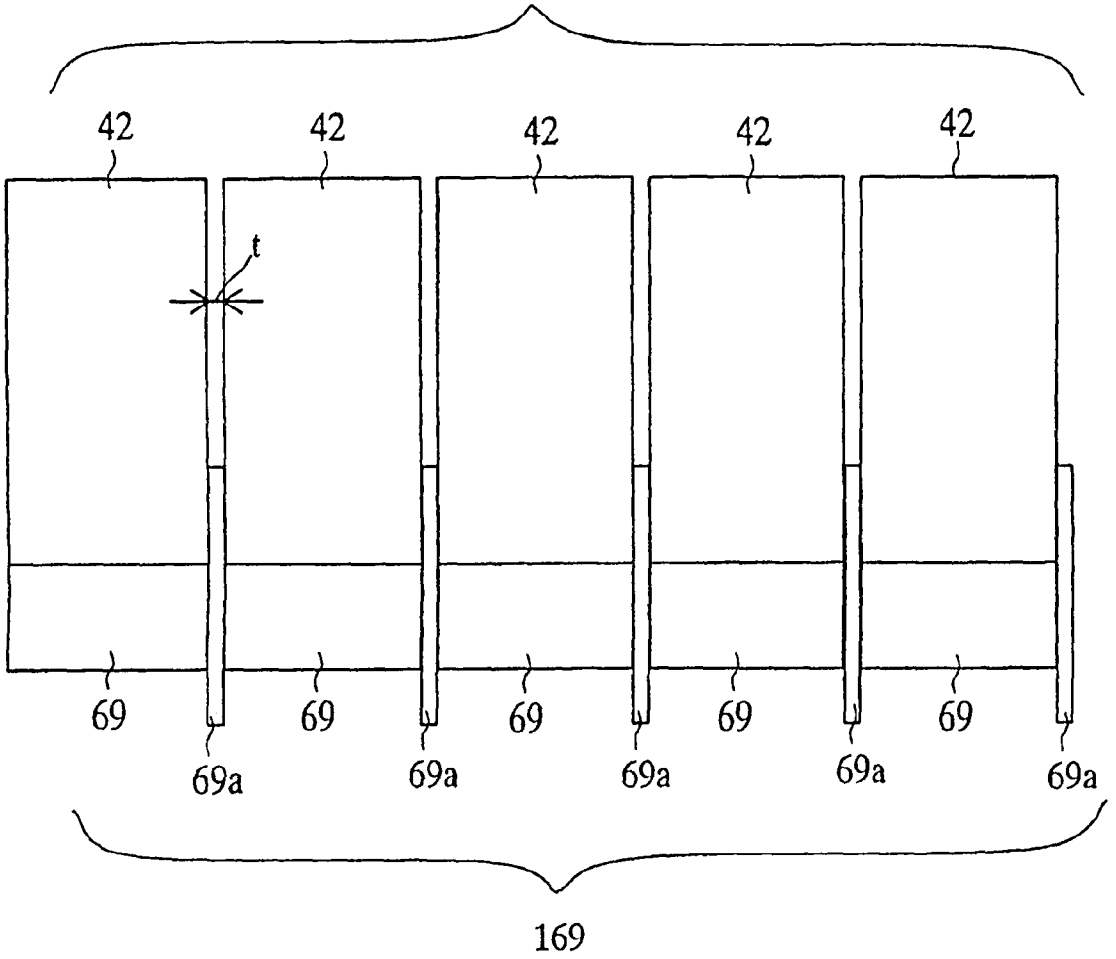
Fig.8 (a) Prior Art
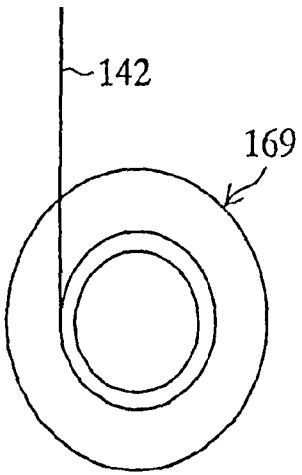
Fig.8 (b) Prior Art

METHOD OF JUDGEMENT OF INK RIBBON JAMMING

CROSS-REFERENCE TO RELATED APPLICATION

This application is a divisional application of U.S. patent application Ser. No. 11/297,108, filed Dec. 7, 2005.

TECHNICAL FIELD

The present invention relates to a method of judgment of occurrence of ink ribbon jamming of an ink ribbon unit having cylindrical ribbon cores for winding an ink ribbon around the outside peripheral face thereof.

TECHNICAL BACKGROUND

Thermal transfer type printers are known which form (or print) an image on a recording medium (paper sheet) by pressure-contacting a thermal head against a peripheral face of a platen roller with interposition of the recording medium and an ink ribbon. In the thermal transfer type printer, an ink ribbon cassette is set removably in which an ink ribbon of a predetermined width is wound around a cylindrical ribbon cores. In the ink ribbon cassette, a ribbon-delivery core holds an unused ink ribbon wound around it and delivers the ink ribbon, and another core, a ribbon-winding-up core, winds up the used ink ribbon.

In the image formation by the printer, a platen roller is rotated at a constant rotation speed to deliver the ink ribbon at a constant delivery speed from the ink ribbon-delivery core. The ribbon-delivery core, while holding a sufficient amount of the unused ink ribbon wound thereon, is rotated at a low rotation speed since the outside diameter of the wound ribbon is large. With progress of delivery of the ink ribbon from the ribbon-delivery core, the outside diameter of the wound ribbon gradually decreases to increase gradually the rotation speed of the ribbon-delivery core. In contrast, on the ribbon-winding-up core, the outside diameter of the wound ribbon increases with progress of the delivery of the ribbon from the ribbon-delivery core, resulting in gradual decrease of the rotation speed thereof.

Accordingly, the amount of the remaining unused ink ribbon can be estimated by measurement of the rotation speed of the ribbon-delivery core (or the ribbon-winding-up core) to estimate the outside diameter of the wound ribbon. For measurement of the rotation speed, in a known technique, a flange having a magnetic member is provided at a lengthwise end of the ribbon core, and the rotation speed is measured by detecting the magnetic force lines generated by the magnetic member (e.g., Japanese Patent Laid-Open No. 2003-211801)

DISCLOSURE OF THE INVENTION

In the above known technical method, a flange having a magnetic member is provided on the ribbon core and the rotation speed is measured by detecting the magnetic force lines generated by the magnetic member. In this constitution, parts or a member of the ink ribbon unit may be placed between the magnetic sensor and the flange, which necessitates a stronger magnetic force of the magnetic member. The stronger magnetic force may attract a clip, a staple or the like to cause adhesion thereof to the flange. The clip or the like adhering to the ribbon core flange not removed, on setting the ink ribbon unit on the printer main body, may cause inconvenience in the ink ribbon unit, or the clip dropped in the main body of the printer may cause disorder of the printer.

In winding up the ink ribbon around the cylindrical ribbon core, the flange of the ribbon core can obstruct the winding operation. Further, with the flanged core, the ink ribbon should be cut and removed in the width corresponding to the flange thickness in winding up the ink ribbon around the ribbon core to cause waste of the part of the ribbon and to cause an increase of cost.

Under the above circumstances, the present invention intends to provide an ink ribbon unit which enables estimation of the amount of the remaining unused ink ribbon without providing a flange on the ribbon core and does not cause inconvenience of the ribbon unit or disorder of the printer main body. The present invention intends also to provide a quick method for judgment of occurrence of ink ribbon jamming.

MEANS FOR SOLVING THE PROBLEM

To achieve the above objects, the ink ribbon unit of the present invention is provided with a cylindrical ribbon core which has an outside peripheral face for winding up an ink ribbon of a prescribed width and rotates in the direction of the peripheral face, comprising (1) a magnetic force-generating means for generating magnetic force lines directed from a first limited portion of the inside peripheral face of the ribbon core toward a second limited portion thereof opposing to the first limited portion, and (2) a magnetic sensor for detecting the magnetic force lines generated by the magnetic force-generating means only when the direction of the magnetic force lines comes to coincide with a predetermined direction.

(3) The magnetic force-generating means may comprise (3-1) a first magnet fixed onto the first limited portion of the ribbon core, and (3-2) a second magnet fixed onto the opposing second limited portion of the ribbon core to form magnetic force lines in combination with the first magnet.

(4) The magnetic sensor may be fixed onto a position surrounded by the inside peripheral face of the ribbon core.

(5) The ribbon core may be made of a non-magnetic material, and (6) the ribbon core may be magnetized only at the first limited portion and the opposing second limited portion.

(7) The first magnet and the second magnet may be distinguishable visually.

(8) The magnetic sensor may detect the magnetic force lines in every one rotation of the ribbon core.

(9) The magnetic sensor may detect the magnetic force lines in every half rotation of the ribbon core.

To achieve the above object, a method for judgment of ink ribbon jamming of the present invention comprises

(10) generating magnetic force lines invariably in the direction from a first limited portion of the inside wall face of the ribbon core toward an opposing second limited portion thereof, with rotation of a cylindrical ribbon core having an outside peripheral face with a ribbon of a predetermined width wound thereon,

(11) detecting only the magnetic force lines in a predetermined direction, and

(12) judging occurrence of the ink ribbon jamming from a time interval of detection of the magnetic force lines.

To achieve the above object, another method of judging ink ribbon jamming of the present invention comprises

(13) generating magnetic force lines invariably in the direction from a first limited portion of the inside face of the ribbon core toward an opposing second limited portion thereof with rotation of a cylindrical ribbon core having an outside peripheral face with a ribbon of a predetermined width wound thereon, and simultaneously generating a constant pulse,

(14) detecting only the magnetic force lines in a predetermined direction,

(15) counting the number of the pulse in a time interval of detection of the magnetic force lines, and

(16) judging occurrence of the ink ribbon jamming from the count number of the pulse.

(17) In judgment of occurrence of the ink ribbon jamming from the counted number of the pulse, the ink ribbon jamming may be judged to have occurred when the counted number of the pulse is larger than a prescribed maximum number.

Further,

(18) In judgment of occurrence of the ink ribbon jamming from the counted number of the pulse,

(19) two pulse numbers detected in successive two time intervals of the magnetic force line detection are compared, and

(20) the ink ribbon jamming may be judged to have occurred when the difference in the counted numbers of the pulse is larger than a prescribed number.

Further,

(21) In judging the ink ribbon jamming from the counted number of the pulse,

(22) during the time period from start of the rotation of the ribbon core to rotation to a prescribed accumulated rotation number, the ink ribbon jamming may be judged to have occurred when the counted number of the pulse is larger than a prescribed maximum number, and

(23) after the rotation to the prescribed accumulated rotation number of the ribbon core, two pulse numbers of successive two time intervals of the magnetic force line detection are compared, and

(24) the ink ribbon jamming may be judged to have occurred when the difference in the counted numbers of the pulse is larger than a prescribed number.

In the ink ribbon unit of the present invention, the magnetic force-generating means generates magnetic force lines directed from a first limited portion of the internal face of the ribbon core toward a second limited portion thereof opposing to the first limited portion, so that the amount of the remaining unused ribbon can be estimated without providing a flange attached to the ink ribbon core. Further, since no flange attracting a magnetizable matter is employed, neither inconvenience of the ink ribbon unit nor disorder of the printer main body will not be caused.

According to the method for judging occurrence of the ribbon jamming of the present invention, an ink ribbon jamming is judged by generating magnetic force lines constantly in the direction from a first limited portion of the inside face of the ribbon core toward an opposing second limited portion thereof, detecting only the magnetic force lines in a predetermined direction, and judging occurrence of the ink ribbon jamming from a time interval between successive detection of the magnetic force lines. Therefore, the ink ribbon jamming can be judged quickly. The recording medium can cause jamming also by jamming of the ink ribbon. Therefore, the jamming of the recording medium can also be judged quickly.

BRIEF DESCRIPTION OF THE DRAWINGS

FIG. 3A shows the state in which the direction of the magnetic force lines coincides with the predetermined direction (detection direction), and FIG. 3B shows a state in which the direction of the magnetic force lines is different from the predetermined direction.

FIG. 7 illustrates schematically a method of winding an ink ribbon around the ribbon core of the constitution of FIG. 5.

FIG. 8 illustrates schematically a method of winding an ink ribbon around a ribbon core of the ink ribbon unit of a comparative example: FIG. 8A is a front view, and FIG. 8B is a side view.

BEST MODE FOR CARRYING OUT INVENTION

The present invention has been achieved for a thermal transfer type printer which forms an image on a recording medium by pressing a thermal head against a platen roller with interposition of an ink ribbon and a recording medium.

Example 1

A printer incorporating an ink ribbon unit of the present invention is explained by reference to FIG. 1.

Figure 1:
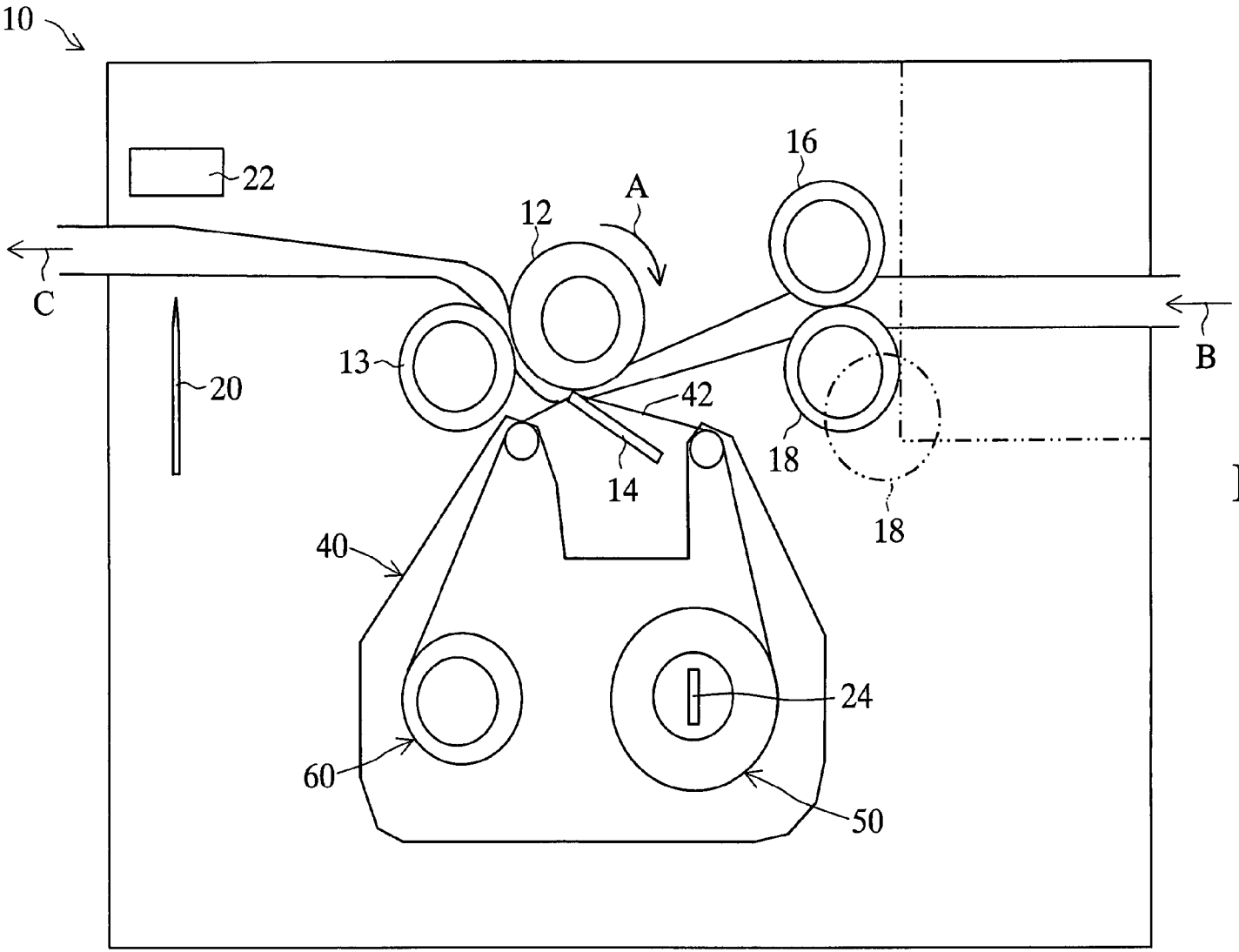
FIG. 1 illustrates schematically an outline of a printer incorporating an ink ribbon unit of the present invention.

FIG. 1 illustrates schematically a printer incorporating an ink ribbon unit of the present invention.

The printer 10 is a thermal transfer type printer which forms (prints) an image by pressing a thermal head 14 against a peripheral face of a platen roller 12 rotating in the arrow-A direction with interposition of a recording medium (printing medium like a tube or a tape) and an ink ribbon 42. Into this thermal transfer type printer 10, an ink ribbon cassette 40 is inserted removably. The ink ribbon cassette 40 has cylindrical ribbon cores 50,60 carrying an ink ribbon 42 of a predetermined width (length in the direction perpendicular to the paper sheet face of FIG. 1) wound between the ribbon cores. The ribbon cores 50,60 include a ribbon-delivery core 50 for delivering an unused portion of the ink ribbon wound thereon and a ribbon-winding-up core 60 for winding up the ribbon delivered from the ribbon delivery core 50 and having been used for the printing. In image formation on a printing medium with the printer 10, the platen roller 12 is rotated at a constant rotation speed to deliver the printing medium nipped between the platen roller 12 and a driven roller 13 at a constant delivery rate, and to deliver the ink ribbon 42 at a constant delivery rate from the ribbon delivery core 50.

The printing medium is fed in the arrow-B direction and is discharged in the arrow-C direction. The printing medium fed in the arrow-B direction is nipped and delivered between the delivery roller 16 and the driven roller 18. The driven roller 18 is constructed to be displaced in connection with the opening-closing movement of a cover (not shown in the drawing). By opening the cover, the driven roller 18 is displaced from the position indicated by the solid line to another position indicated by the two-dot chain line to be separated from the delivery roller 16 to facilitate insertion of the printing medium as shown in the drawing. By closing the cover, the driven roller 18 is moved to the position for pressing the delivery roller 16 to deliver the printing medium surely between the two rollers 16,18. The printing medium after the image formation is cut in a suitable length by a cutter 20 and a cutting block 22, and is discharged in the arrow-C direction. The printing medium includes label tapes, flattened tubes, 4-mm ID (index), and so forth. Such a printing medium is wound and enclosed in a single-purpose cassette (not shown in the drawing).

A magnetic sensor 24 is fixed to the main body of the printer 10. This magnetic sensor 24 detects only magnetic force lines in a predetermined direction. With the ribbon cassette 40 set in the main body of the printer 10, the magnetic sensor 24 is placed at the center of the space surrounded by the inside peripheral wall face of the cylindrical ribbon-delivery core 50. In this example, the ink ribbon unit of the present invention is constituted of the aforementioned ink ribbon cassette 40 and the magnetic sensor 24. By setting the ink ribbon cassette 40 in the main body of the printer 10, a rotation axis (not shown in the drawing) is inserted respectively into the inside space (surrounded by the inside wall face) of the ribbon-delivery core 50 and that of the ribbon-winding-up core 60. Thereby the ribbon-delivery core 50 and the ribbon-winding-up core 60 are rotated at a predetermined rotation speed. On the other hand, the magnetic sensor 24 is fixed immovably onto a separate axis other than the above rotation axises on the main body of the printer 10.

The ribbon-delivery core 50 of the ink ribbon cassette 40 in FIG. 1 is explained by reference to FIG. 2.

Figure 2:
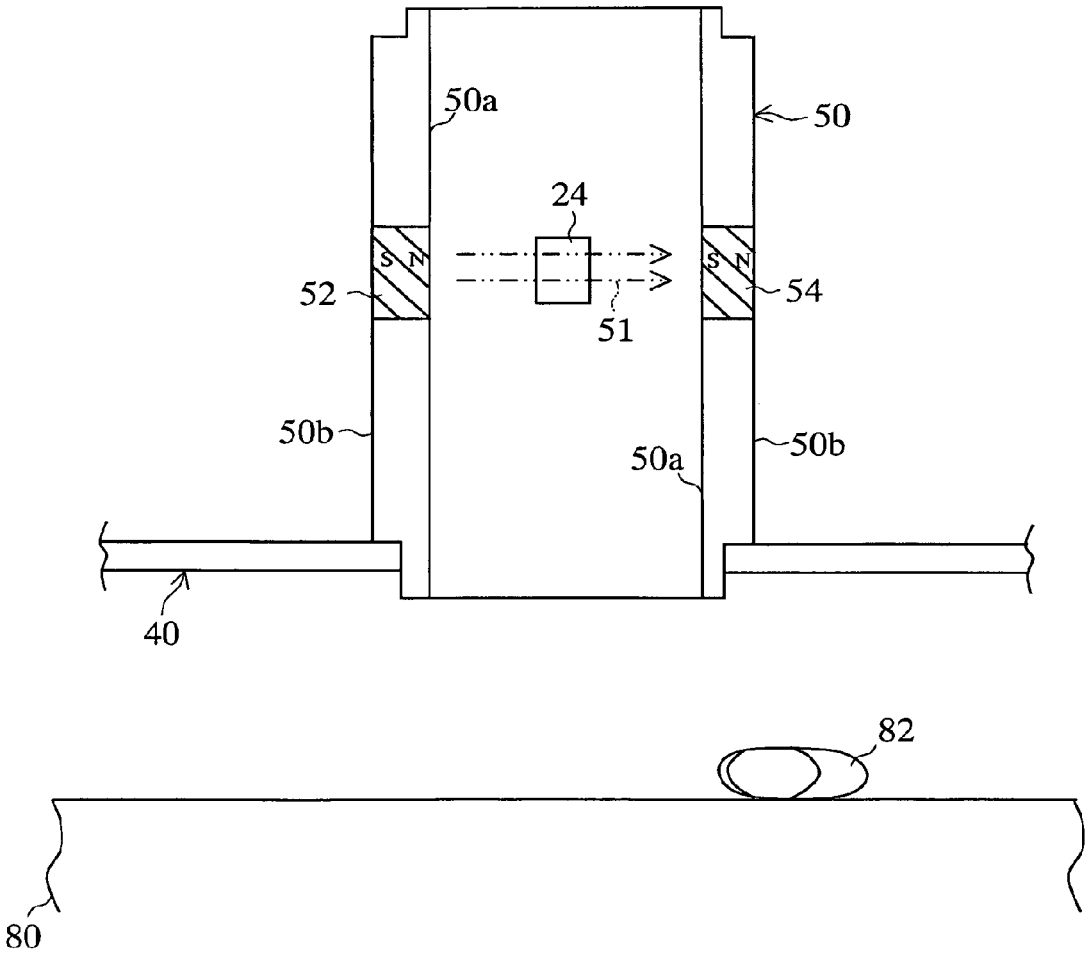
FIG. 2 is a cross-sectional view of a part of the ribbon-delivery core of the ribbon unit shown in FIG. 1.

FIG. 2 is a cross-sectional view of a part of the ribbon-delivery core of the ink ribbon unit shown in FIG. 1. In FIG. 2, the same reference symbols as in FIG. 1 are used for denoting corresponding constitutional elements.

The ribbon-delivery core 50 is cylindrical in the shape as mentioned above. A magnetic force lines 51 are generated between a portion (a first portion) of the inside wall face 50*a* and the opposite portion (a second portion) thereof. A first magnet 52 is fixed onto the first portion, and a second magnet 54 is fixed in the opposite second portion. The first magnet 52 has its N pole on the inside wall face 50*a* and its S pole on the outside peripheral face 50*b*. The second magnet has its S pole on the inside wall face 50*a* and its N pole fixed on the outside peripheral face 50*b*. Therefore, inside the ribbon-delivery core 50 (the space surrounded by the inside wall face 50*a*), a magnetic force lines 51 are generated in the direction from the N pole of the first magnet 52 to the S pole of the second magnet 54.

When the ink ribbon cassette 40 is taken out from the main body of the printer 10, a foreign matter 82 such as a clip dropped on the floor 80 cannot be attracted by the magnetic force to the ribbon cassette 40, since the first magnet 52 and the second magnet 54 are placed inside apart from the casing of the ink ribbon cassette.

In the state that the ink ribbon cassette 40 is set to the main body of the printer 10, the magnetic sensor 24, which is positioned at the inside center portion of the ribbon-delivery core 50, detects the magnetic force lines 51. This detection is explained by reference to FIGS. 3 and 4.

Figure 3:
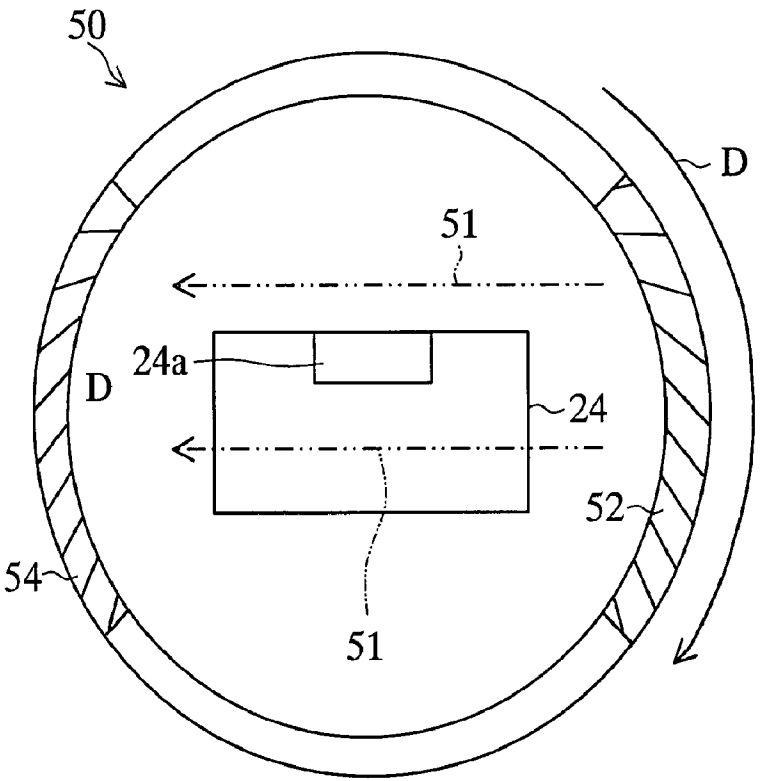
FIG. 3 is a cross-sectional view showing relative positions of the ribbon core having two magnets fixed thereon and the magnetic sensor.
Figure 3:
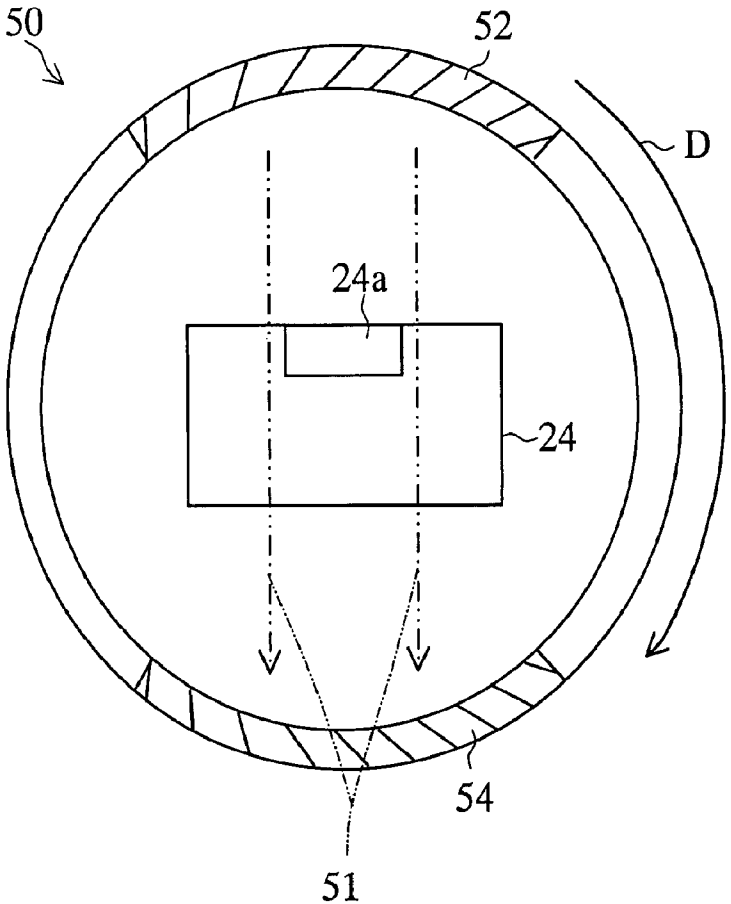
Figure 4:
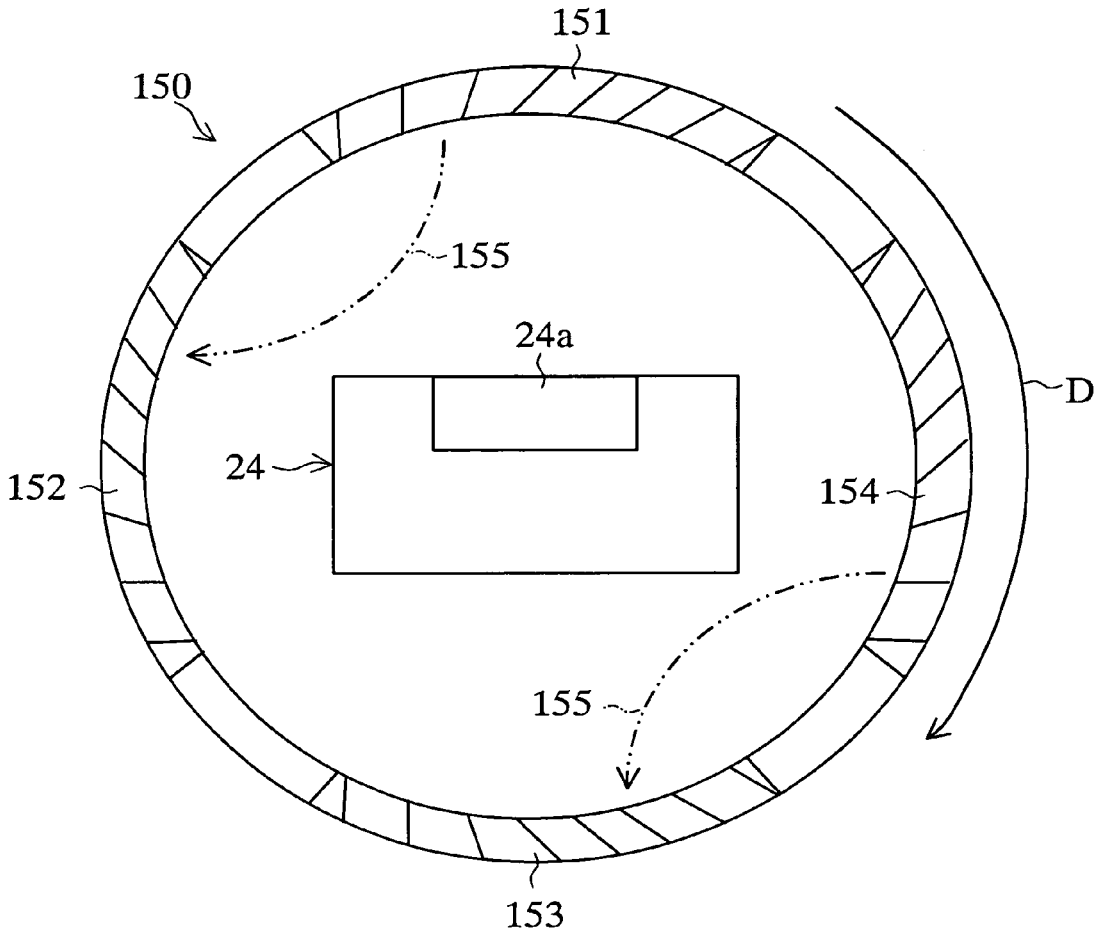
FIG. 4 is a cross-sectional view of the ribbon core of comparative example in which four magnets are fixed on the ribbon core.

The magnetic force lines and detection thereof in the ribbon core of FIG. 2 is explained by reference to FIGS. 3 and 4.

FIGS. 3A and 3B are cross-sectional views showing the positional relation between the ribbon core having two magnets and the magnetic sensor. FIG. 3A illustrates the magnetic force in the predetermined direction (detectable direction), and FIG. 3B illustrates the magnetic force not in the predetermined direction (not detectable). FIG. 4 is a cross-sectional view of the ribbon core of the comparative example in which four magnets are employed.

The magnetic sensor 24 has a detection element 24*a* for detecting magnetic force lines. The detection element 24*a* includes two types: two-pole detection type element which is capable of differentiating the positions of the N pole and the S pole (capable of differentiating the direction of the magnetic lines); and one-pole detection type element which is capable of detecting magnetic force lines but incapable of differentiating the positions of the N pole and the S pole. With either type of the detection element 24*a*, the magnetic force lines 51 are detected by the detection element 24*a*, only when the direction of the magnetic force lines 51 comes to coincide with the predetermined direction (detection direction) as shown in FIG. 3A. Here, the detection direction signifies the direction of the magnetic force lines 51 shown in FIG. 3A and the direction reverse thereto. The magnetic force lines 51 in the direction different from the predetermined direction (detection direction) are not detected by the detection element 24*a*.

Therefore, with the detection element 24*a* of the two-pole detection type, during one rotation of the ribbon-delivery core 50 in its periphery direction (arrow-D direction), the magnetic force lines 51 are detected twice in reversed directions. That is, the magnetic force lines 51 are detected by differentiating the direction once in half rotation in the periphery direction (in the arrow-D direction) of the ribbon-delivery core 50. On the other hand, with the detection element 24*a* of the one-pole detection type, the magnetic force lines 51 are detected without differentiating the direction once in half rotation in the periphery direction (in the arrow-D direction) of the ribbon-delivery core 50. In the above examples, the magnetic force is designed to be generated inside the ribbon-delivery core 50. Otherwise, the magnetic force may be designed to be generated inside the ribbon-winding-up core 60.

In the above ribbon-delivery core 50, two magnets 52,54 are placed in opposition to generate the magnetic lines within the ribbon-delivery core 50. Instead, three or more magnets could be employed. For example, as shown in FIG. 4, four magnets 151,152,153,154 could be employed in equal intervals along the periphery in the ribbon-delivery core 150. However, with the four magnets, the magnetic force lines 155 can be directed to the adjacent magnets to prevent the detection of the magnetic force lines by the magnetic sensor 24. Therefore, only two magnets 52,54 are provided in the opposing positions.

An example of the process for preparing the ribbon core is explained by reference to FIGS. 5 and 6.

Figure 5:
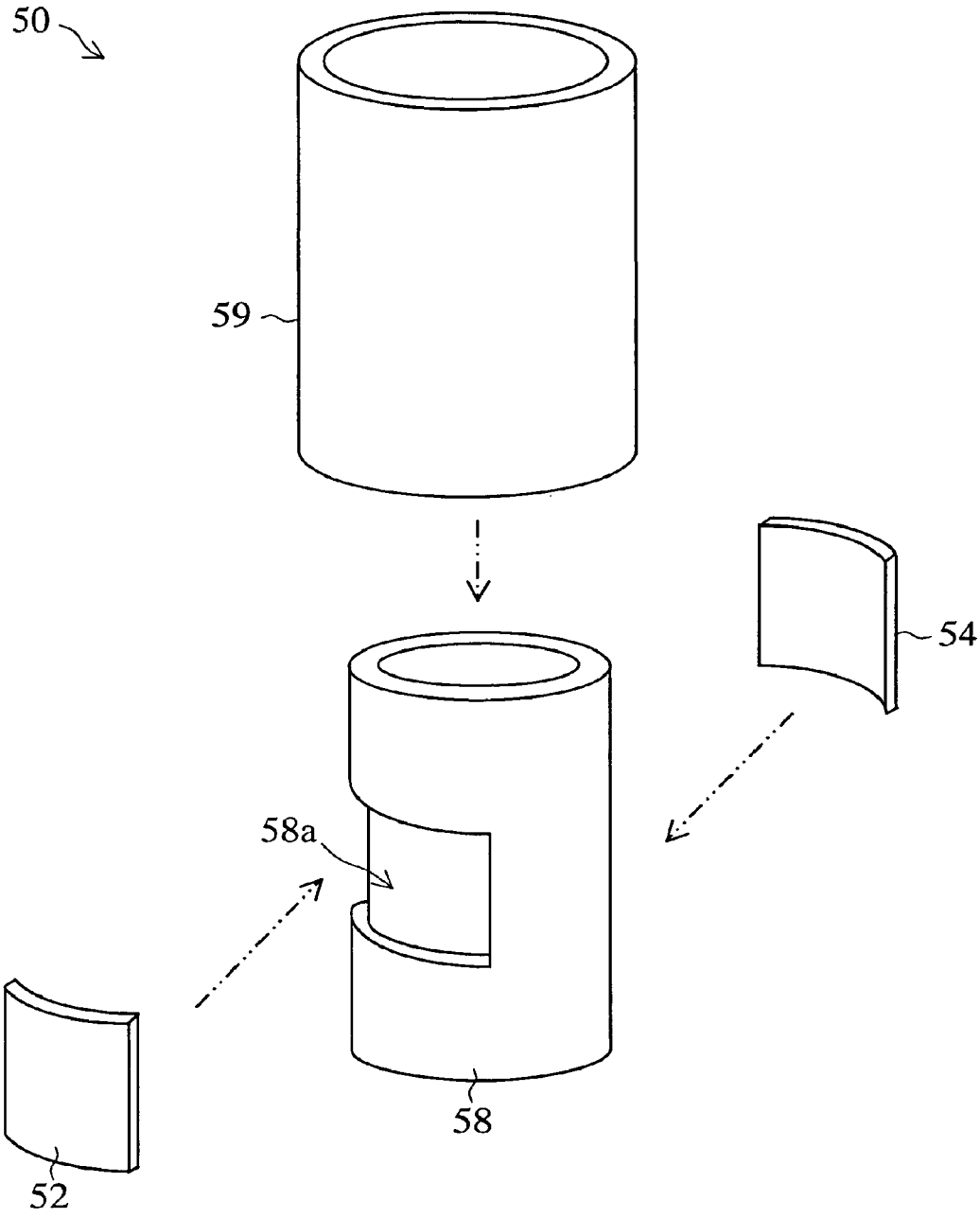
FIG. 5 is a perspective view showing assemblage of the ribbon core.
Figure 6:
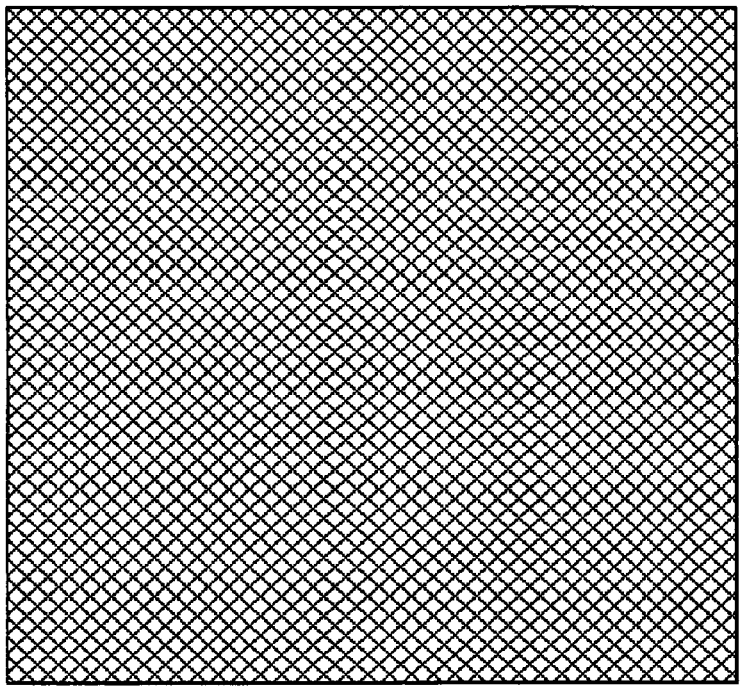
FIG. 6 is a schematic drawing showing a method for differentiating two kinds of the ribbon core magnets.
Figure 6:
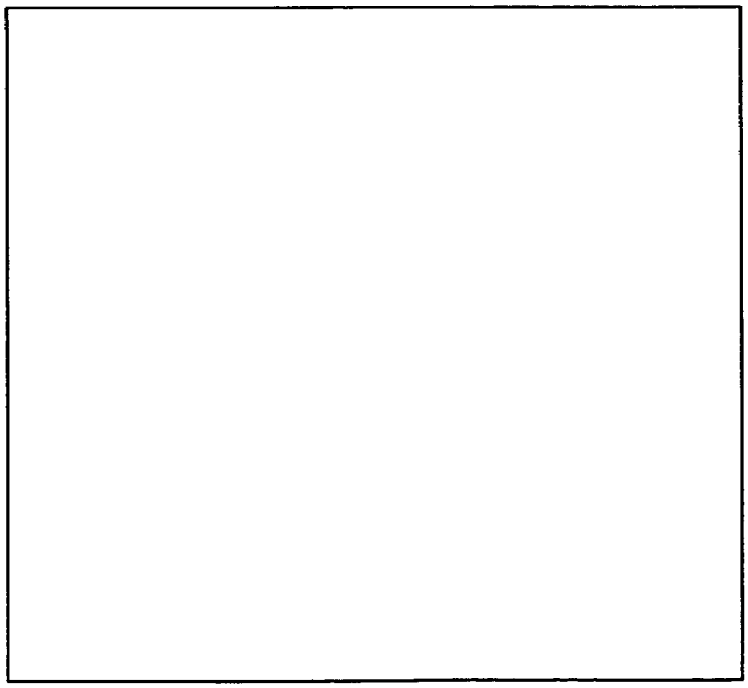

FIG. 5 is a perspective view illustrating the process for assembling the ribbon core. FIG. 6 shows schematically a method for differentiating the kinds of the ribbon core magnets. In these drawings, the same symbols as in FIG. 3 are used for denoting corresponding elements.

The ribbon-delivery core 50 is constituted of an inner core 58 and an outer core 59, respectively made of a non-magnetic material. The inner core 59 has an outside diameter slightly smaller than the inside diameter of the outer core 59. The two cores 58,59 have nearly the same height. The inner core 58 has a depression 58*a* for bonding of the first magnet 52 and a second depression (not shown in the drawing) for bonding of the second magnet 54. The first magnet 52 is bonded to the depression 58*a*, and the second magnet 54 is bonded to the second depression similarly. Then the outer core 59 is fitted outside the inner core 58. Thereby the ribbon-delivery core 50 is prepared in which the first magnet 52 and the second magnet 54 are fixed, and the intended opposing positions only are magnetized.

The first magnet 52 and the second magnet 54 cannot usually be differentiated visually from each other. To facilitate the visual differentiation between the first magnet 52 and the second magnet 54, the N pole side surfaces of the first and second magnets are embossed as shown in FIG. 6 without embossing the S pole side surface. Thereby the error in assemblage can be prevented, even when the first magnets 52 and the second magnets 54 are stored mixedly in a large number.

A method is explained for winding an ink ribbon around a ribbon core having the structure shown in FIG. 5 by reference to FIGS. 7 and 8.

Figures 7A, 7B:
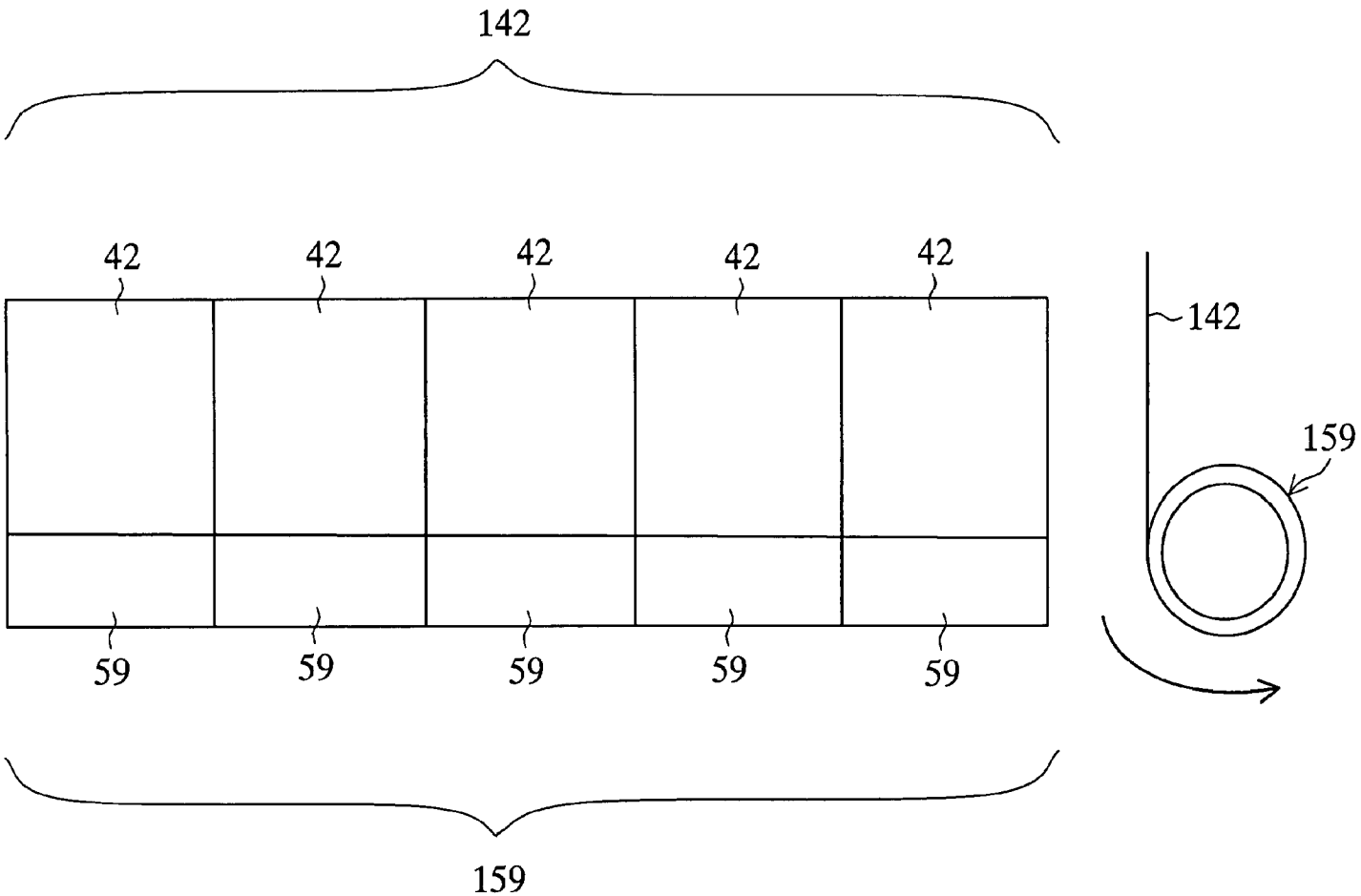
FIG. 7A is a front view.
FIG. 7B is a side view.

FIG. 7 illustrates schematically a method for winding an ink ribbon around a ribbon core having the structure shown in FIG. 5. FIG. 7A is a front view, and FIG. 7B is a side view. FIG. 8 illustrates schematically a method for winding an ink ribbon around a ribbon core in the ink ribbon unit of comparative example. FIG. 8A is a front view, and FIG. 8B is a side view.

For winding the ink ribbon 42 (FIG. 1) around the ribbon-delivery core 50, there are prepared a long core 159 constituted of connection of several units of the outer core 59, and a wide ink ribbon 142 having nearly the same width as that of the long core 159. This wide ink ribbon 142 is wound around the outside peripheral face of the long core 159 by rotating the long core by a rotation device (not shown in the drawing) by cutting the broad ink ribbon 142 in a width of the intended ink ribbon 42. After winding up the intended length of the ink ribbon 42, the long core 159 having the cut and wound ink ribbons 42 is divided into the unit cores having the length of the outer core 59. Thereby, the plural outside cores 59 carrying the ink ribbon can be obtained readily. Thereafter, as explained by reference to FIG. 5, the ribbon-delivery core 50 can be prepared readily which has an ink ribbon 42 wound around.

In contrast, in the case where the employed outer core 69 has a flange 69*a* as shown in FIG. 8, the wide ribbon is wound by cutting and discarding a portion of the wide ink ribbon 142 corresponding to the thickness t of the flange 69*a*. This increase the waste of the wide ink ribbon 142, and the flange 69*a* hinders the winding operation and lowers the operation efficiency.

A technique of judgment of ink ribbon jamming is explained by reference to FIGS. 9 and 10.

Figure 9:
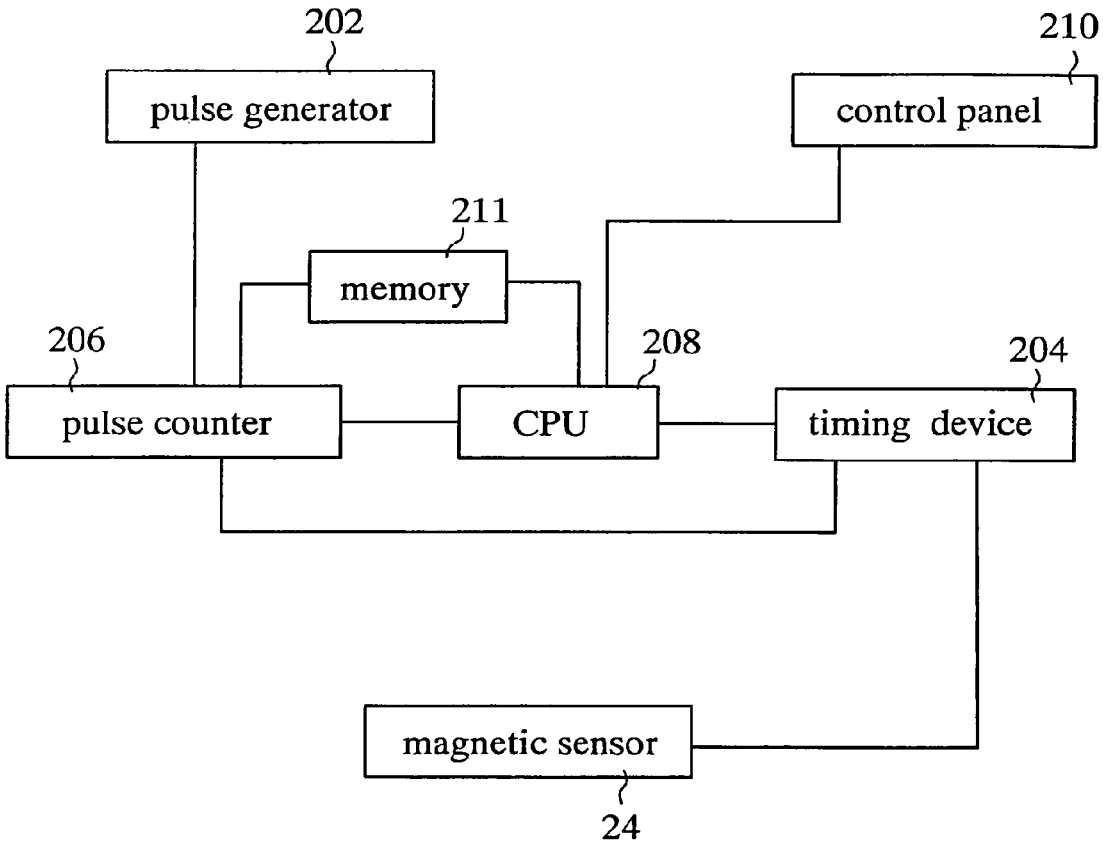
FIG. 9 is a block diagram showing a jam-judging unit for judging jamming of the ink ribbon.
Figure 10:
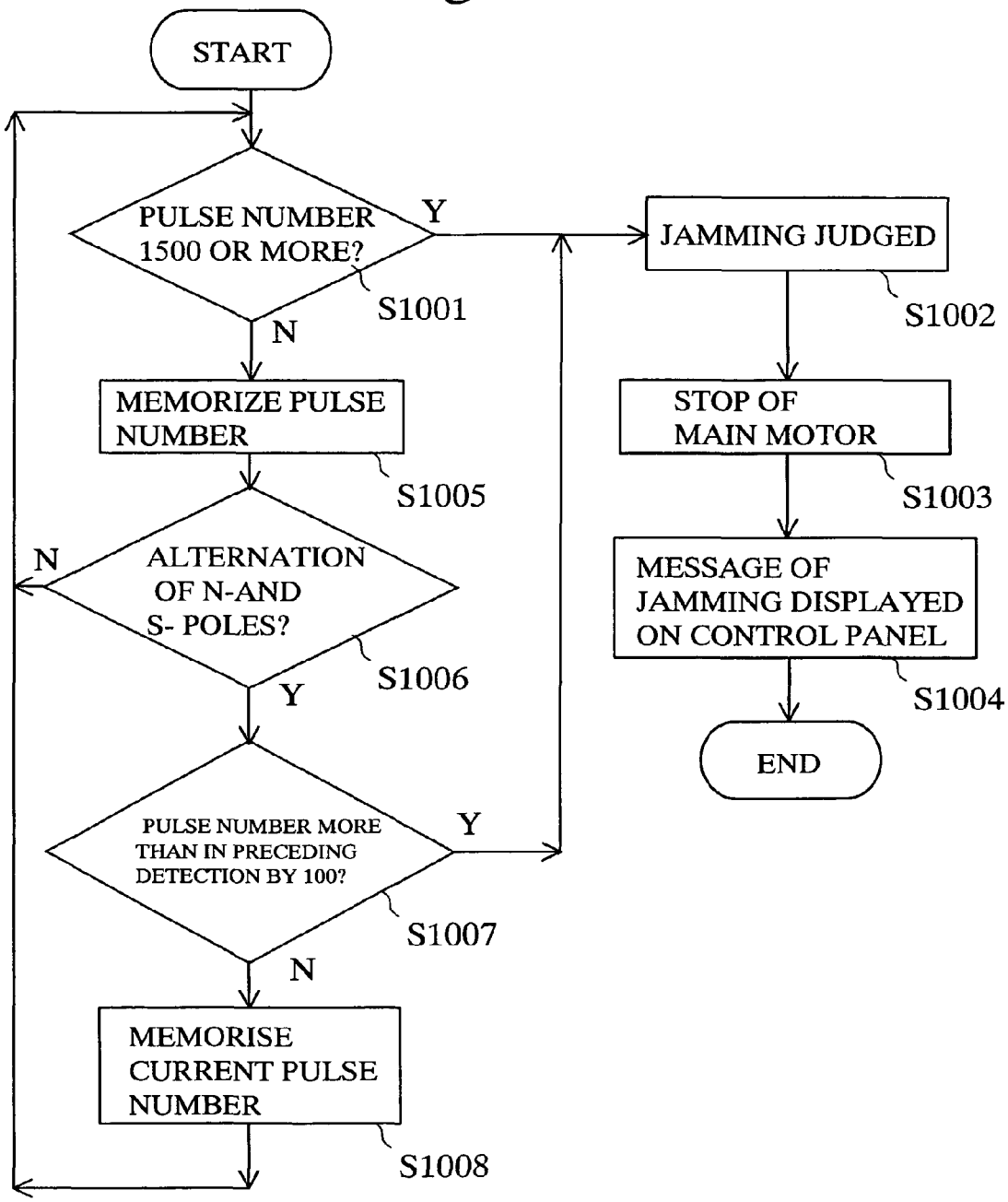
FIG. 10 is a flow chart showing an example of the steps for judging jamming of the ink ribbon.

FIG. 9 is a block diagram of the jam-judgment unit for judging the ink ribbon jamming. FIG. 10 is a flow chart showing an example of a procedure for judgment of ink ribbon jamming.

The jam-judgment unit 200 comprises a pulse generator 202; a time-measuring device 204 for measuring the time interval of the detection of magnetic force lines (magnetic field) by a magnetic sensor 24 (FIG. 1, etc.); a pulse counter 206 for counting the pulses generated by the pulse generator 202 during the time of measurement by the time-measuring device 204; and the above magnetic sensor 24. The pulse generator 202, the time-measuring device 204, and the pulse counter 206 are built in the main body of the printer 10 (FIG. 1, etc.). An example of the number of the pulse generated by the pulse generator 202 at constant time intervals is a pulse number of 1500, generated during one rotation of the ribbon-delivery core 50 carrying ink ribbon 42 (FIG. 1) fully wound (before use of the ink ribbon).

A signal of detection of magnetic force lines 51 by the magnetic sensor 24 (FIG. 1, etc.) is sent to CPU 208. The CPU 208 drives a pulse counter 206 in accordance with the received signal. On judging the jamming of the ink ribbon 42 (occurrence of ribbon jamming), the CPU displays a message of "Jamming" on a control panel 210.

In an example, the judgment of ink ribbon jamming is based on a time interval of detection of magnetic force lines 51 (FIG. 3, etc.) by the magnetic sensor 24. This time interval is measured by the time-measuring device 204. With the ribbon-delivery core 50, at the beginning of the use of the ribbon 42, the core is rotated slowly owing to a large amount of the unused wound ribbon 42. The rotation becomes gradually faster with use of the ink ribbon. When the ink ribbon 42 jams, the delivery of the ink ribbon 42 is retarded, causing sudden decrease of the rotation rate of the ribbon-delivery core 50. Therefore the jamming of the ink ribbon 42 is judged by the aforementioned time interval.

On the other hand, in the case where the first magnet 52 and the second magnet 54 are installed in the ribbon-winding-up core 60 for detection of ribbon jamming, the phenomenon is reverse to the case of the ribbon-delivery core 50. At the beginning of the use of the ribbon, the ribbon-winding-up core 60 is rotated fast owing to absence of the wound ribbon 42. The rotation becomes gradually slower with gradual increase of the wound ribbon after use. When the ink ribbon 42 jams, the delivery of the ink ribbon 42 is retarded, causing sudden decrease of the rotation rate of the ribbon-winding-up core 60. Therefore the jamming of the ink ribbon 42 is judged by the aforementioned time interval.

Another example of detection of the jamming of the ink ribbon is explained by reference to FIG. 10.

This flow of the operation is started by turning on the power source of the printer 10 to drive the main motor to rotate the ribbon-delivery core 50. With power application to the printer 10, are driven the pulse generator 202, the time-measuring device 204, the pulse counter 206, the CPU 208, the magnetic sensor 24, and so forth. In this example, the magnetic sensor 24 is of the above-mentioned two-pole detection type. In every half rotation time of the ribbon-delivery core 50, the number of the pulse is counted by the pulse counter 206. In this example, the pulse generator 202 generates pulse of 1500 during the time of one rotation of the ribbon-delivery core 50 carrying the ink ribbon 42 (FIG. 1) fully wound (unused rink ribbon).

Firstly, after start of rotation of the ribbon-delivery core 50, the pulse counter 206 counts the number of the pulses in half rotation of the core to judge whether or not the pulse number is not less than 1500 (S1001). The detected pulse number of not less than 1500 signifies that the rotation speed of the ribbon-delivery core 50 is less than the normal rotation speed of the core 50 carrying a fully wound ribbon, indicating possibility of jamming of the ribbon 42 (or the printing medium) (S1002). Then the main motor is stopped (S1003), and the control panel 210 displays requirement for inspection of the ink ribbon cassette 40 (S1004).

The detected pulse number of less than 1500 signifies that the rotation speed of the ribbon-delivery core 50 becomes higher owing to gradual delivery of the ink ribbon 42. This pulse number is memorized in the memory 211 (S1005). Then detection of magnetic force lines by the magnetic sensor 24 is examined (S1006) to judge whether the ribbon-delivery core 50 has turned one rotation. When the rotation is less than the one complete rotation, the operation flow is returned to S1001. When the one rotation is judged to have been completed in S1006, the pulse number counted in a first half rotation after start of the rotation of the ribbon-delivery core 50 (the counted pulse number in the first half rotation) and the pulse number counted in a second half rotation next to the above first half rotation (the counted pulse number in the second half rotation) are compared with each other. This comparison is made by CPU 208. Then the difference in the counted pulse numbers between the first half rotation and the second half rotation is examined to judge whether the difference is not less than 100 (S1007). The difference in the counted pulse numbers of not less than 100 shows sudden slow-down of the rotation speed of the ribbon-delivery core 50, suggesting occurrence of jamming of the ink ribbon 42. Then the operation flow is returned S1002 to conduct the steps of S1003 and S1004.

The difference of less than 100 detected in S1007 shows normal rotation of the ribbon-delivery core 50 without jamming of the ink ribbon 42. In this case, the above pulse number in the second half rotation is memorized in the memory 211 (S1008) to replace the pulse number in the first half rotation by the pulse number in the second half rotation. Further the operation is returned to S1001 and the pulse number in half rotation of the ribbon-delivery core 50 is examined whether the pulse number is not less than 1500.

As described above, jamming of the ink ribbon 42 can be detected by examining the magnetic force lines 51 with the magnetic sensor 24.

The invention claimed is:

1. A method for judging ink ribbon jamming, comprising:

generating magnetic force lines, invariably in a direction from a first limited portion of an inside wall face of a ribbon core toward an opposing second limited portion thereof, the ribbon core having an outside peripheral face with a ribbon of a predetermined width wound thereon, placing a magnetic sensor inside the ribbon core to detect the magnetic force lines, rotating the ribbon core around the magnetic sensor, detecting only the magnetic force lines in a predetermined direction, and judging occurrence of the ink ribbon jamming from a time interval between successive detections of the magnetic force lines.

2. A method for judging ink ribbon jamming, comprising:

generating magnetic force lines, invariably in a direction from a first limited portion of an inside wall face of a ribbon core toward an opposing second limited portion thereof, with rotation of the ribbon core having an outside peripheral face with a ribbon of a predetermined width wound thereon, and simultaneously generating a constant pulse, detecting only the magnetic force lines in a predetermined direction, counting a number of the pulse in a time interval of detection of the magnetic force lines, and judging occurrence of the ink ribbon jamming from the counted number of the pulse, wherein, in judging the ink ribbon jamming from the counted number of the pulse, two pulse numbers detected in successive two time intervals of the magnetic force line detection are compared, and the ink ribbon jamming is judged to have occurred when a difference in the counted numbers of the pulse is larger than a prescribed number.

3. The method for judgment of the ink ribbon jamming according to claim 1, further comprising generating pulses, and counting a number of pulses between the time interval between the successive detections of the magnetic force lines.

4. The method for judgment of the ink ribbon jamming according to claim 3, wherein in judging the occurrence of the ink ribbon jamming, the number of the pulses is compared with a predetermined number.

5. The method for judgment of the ink ribbon jamming according to claim 1, wherein in judging the occurrence of the ink ribbon jamming, the time interval from a detection of the magnetic force lines to a next detection of the magnetic force lines is compared.

6. The method for judgment of the ink ribbon jamming according to claim 1, wherein two magnets are arranged in the first and second limited portions at a periphery of the ribbon core to generate the magnetic force lines in a space of the ribbon core.

* * * * *